US008528371B2

(12) United States Patent
Spiegel et al.

(10) Patent No.: US 8,528,371 B2
(45) Date of Patent: Sep. 10, 2013

(54) EVERYDAY SAFE

(76) Inventors: Evan Scott Spiegel, Las Vegas, NV (US); Bizhan Fazeli, Irvine, CA (US)

( * ) Notice: Subject to any disclaimer, the term of this patent is extended or adjusted under 35 U.S.C. 154(b) by 100 days.

(21) Appl. No.: 13/204,651

(22) Filed: Aug. 6, 2011

(65) Prior Publication Data

US 2012/0031154 A1 Feb. 9, 2012

Related U.S. Application Data

(60) Provisional application No. 61/371,466, filed on Aug. 6, 2010.

(51) Int. Cl.
*E05B 73/00* (2006.01)

(52) U.S. Cl.
USPC ..... 70/18; 70/25; 70/30; 70/65

(58) Field of Classification Search
USPC ..... 70/14, 18, 19, 24, 25, 30, 49, 59, 70/63–65
See application file for complete search history.

(56) References Cited

U.S. PATENT DOCUMENTS

| | | | | |
|---|---|---|---|---|
| 1,201,972 | A * | 10/1916 | Kelly | 70/65 |
| 1,814,378 | A | 3/1928 | Gilbertson et al. | |
| 2,440,012 | A * | 4/1948 | Haver | 70/18 |
| 3,483,907 | A | 12/1969 | Corridon | |
| 3,590,608 | A * | 7/1971 | Smyth et al. | 70/15 |
| 3,831,407 | A * | 8/1974 | Coleman | 70/18 |
| 4,493,865 | A | 1/1985 | Kuhlmann et al. | |
| 4,507,353 | A | 3/1985 | Kuhlmann et al. | |
| 4,583,534 | A | 4/1986 | Woods et al. | |
| 5,181,402 | A * | 1/1993 | Faessler et al. | 70/18 |
| 5,408,212 | A | 4/1995 | Meyers et al. | |
| 6,026,662 | A * | 2/2000 | Schlipper | 70/18 |
| 6,167,734 | B1 * | 1/2001 | Derman | 70/18 |
| 6,244,081 | B1 * | 6/2001 | Schlipper | 70/18 |
| 6,474,116 | B1 | 11/2002 | Lai | |
| 7,069,753 | B2 * | 7/2006 | Schlipper | 70/18 |
| 7,104,093 | B2 * | 9/2006 | Ling et al. | 70/30 |
| 7,131,298 | B1 * | 11/2006 | Haraughty | 70/18 |
| 7,146,830 | B2 * | 12/2006 | Huang | 70/25 |
| 7,434,425 | B2 * | 10/2008 | Mahre et al. | 70/18 |
| 8,087,270 | B1 * | 1/2012 | Gruver et al. | 70/18 |

FOREIGN PATENT DOCUMENTS

GB 2359012 A 8/2001

* cited by examiner

*Primary Examiner* — Christopher Boswell
(74) *Attorney, Agent, or Firm* — Sheridan Ross PC; Stanley J. Gradisar

(57) ABSTRACT

An everyday safe bag has a dual lock design. A cable is fixed at one end to a first end of the dual lock. The everyday safe bag has a plurality of small openings located at the open end of the bag that receive the cable there through. A fixed ball is affixed to the cable a first distance from the first end of the dual lock. A channel at a second end of the dual lock receives the fixed ball in a locked position, forming a first loop that cinches the bag closed. A lock fob channel located in a second end of the dual lock receives a lock fob on the other end of the cable in a locked position, forming a larger second loop, which may encompass a fixed object. Dials in the dual lock establish an unlock position or combination that secures and releases the cable.

20 Claims, 22 Drawing Sheets

EVERYDAY SAFE

CROSS-REFERENCES TO RELATED APPLICATIONS

This application claims the benefit of U.S. Provisional Application Ser. No. 61/371,466 filed on Aug. 6, 2010 titled "EVERYDAY SAFE" which is incorporated herein by reference in its entirety for all that is taught and disclosed therein.

BACKGROUND

Many commercial bags provide a means to conceal and enclose the user's personal items. Despite the attempts to hide one's items, there are still many reported cases of lost or stolen belongings in which people's belongings are missing because of the lack of secure encasing or means of enclosing. The present invention provides such security and addresses these worries by enclosing your typical tote bag with a secure mechanism involving a lock and strap and by encasing the user's items with chainmail mesh fabric or other material.

Technical Field

The present invention generally relates to a bag. More particularly, its objective is to provide a safe, secure, and portable means to carry everyday belongings.

SUMMARY

This Summary is provided to introduce in a simplified form a selection of concepts that are further described below in the Detailed Description. This Summary is not intended to identify key features or essential features of the claimed subject matter, nor is it intended to be used to limit the scope of the claimed subject matter.

The detailed description below describes a dual security locking system for a container or bag. The purpose of the invention is to provide a cut resistant, easy to stow, antitheft safe for personal belongings.

The everyday safe bag uses a unique welded chainmail mesh fabric or other sturdy fabric to create a bag that may be cut, slash, and tear-resistant. The everyday safe bag allows safe and secure storage of personal belongings (e.g., wallet, keys, cell phone, MP3 player, sunglasses, etc.) while out at the gym, beach, hotel pool, or any place where theft is a concern.

The everyday safe bag has a dual lock design which protects the bag's contents and anchors the everyday safe bag itself. The dual locking system provides an all-in-one lightweight safe. Items are first placed in the bag. Then, by pulling the braided steel cable, the bag may be cinched tightly closed. Finally, the bag and its contents are secured by wrapping around the remainder of the cable to a stationary object such as a heavy lounge chair, tree, bike rack, or custom rack designed exclusively for the everyday safe bag.

The everyday safe bag shape, size, and function can be altered using various color and fabric styles in combination with the welded chainmail fabric or other fabric and the dual lock system. The everyday safe bag is for all occasions. For example, an elegant handbag for a nightclub wouldn't necessarily be the same size or use the same fabric as a waterproof beach resort bag with a heat resistant liner. Likewise, even larger sizes could accommodate laptops, large purses, or motorcycle helmets.

The everyday safe bag's benefits include an all new soft safe for everyday use, unique cut resistant chainmail fabric, and dual locking system. It is easy to flatten to store in luggage, a gym bag, or a purse. The everyday safe bag offers unprecedented protection and peace of mind for consumers.

DETAILED DESCRIPTION

Figure 1:
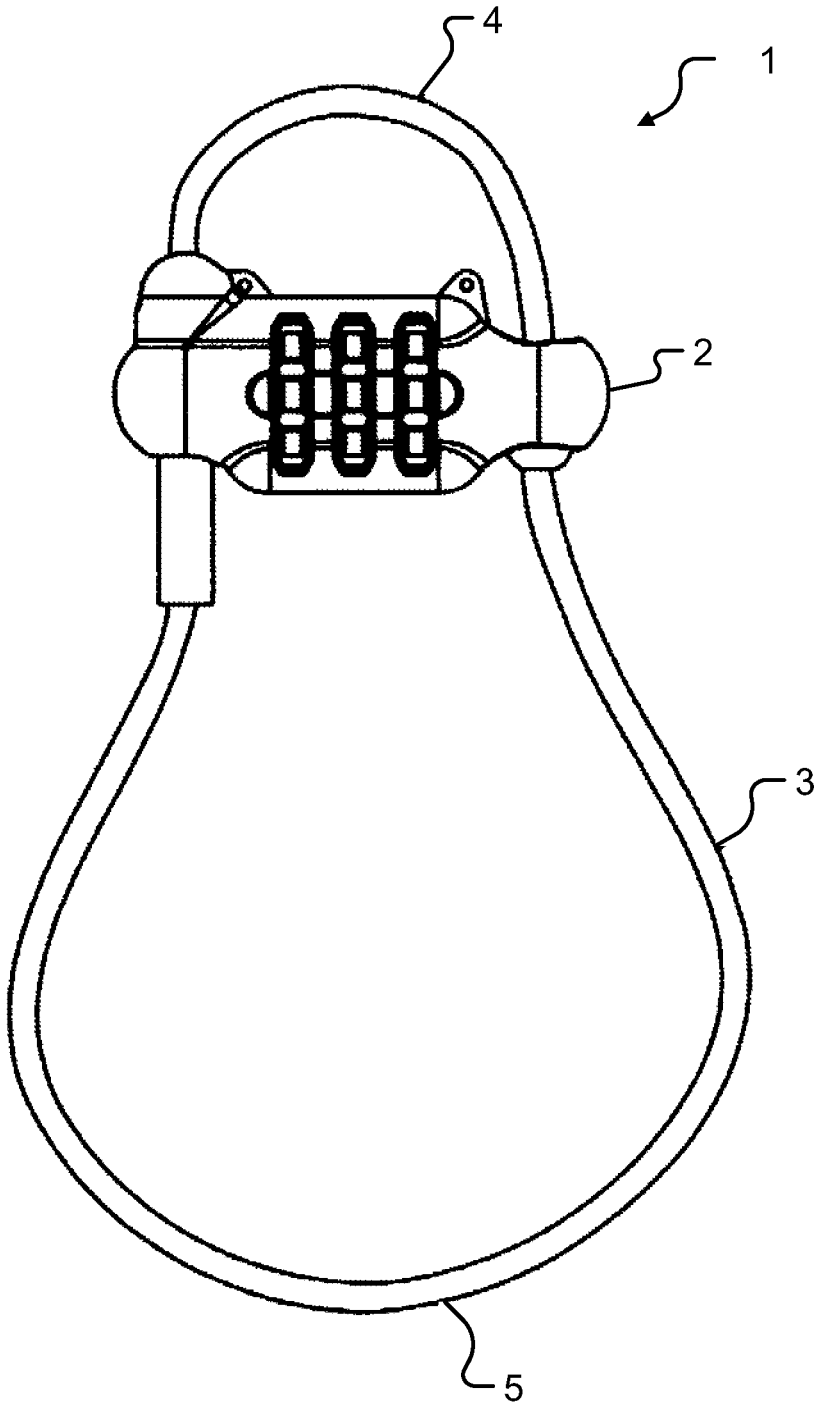
FIG. 1 shows a top view of the dual lock mechanism in an embodiment of the present invention.
Figure 2:
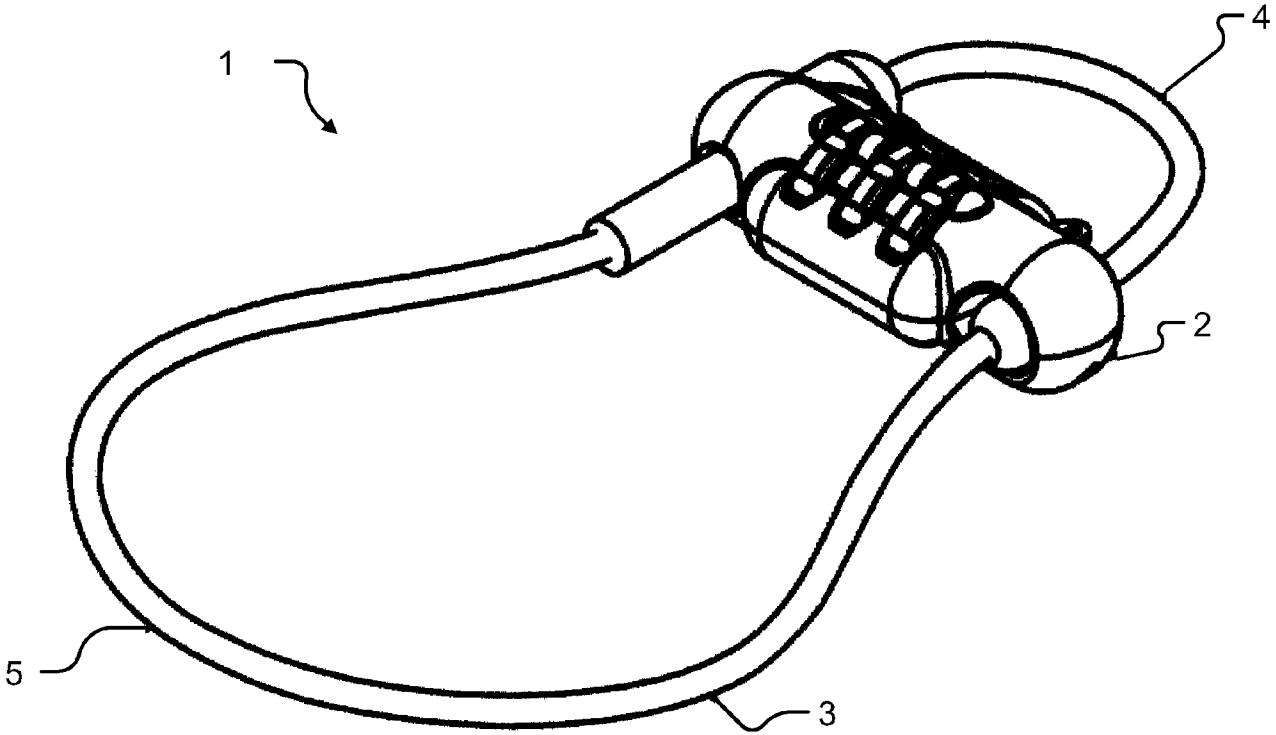
FIG. 2 shows an isometric view of the dual lock mechanism in an embodiment of the present invention.
Figure 3:
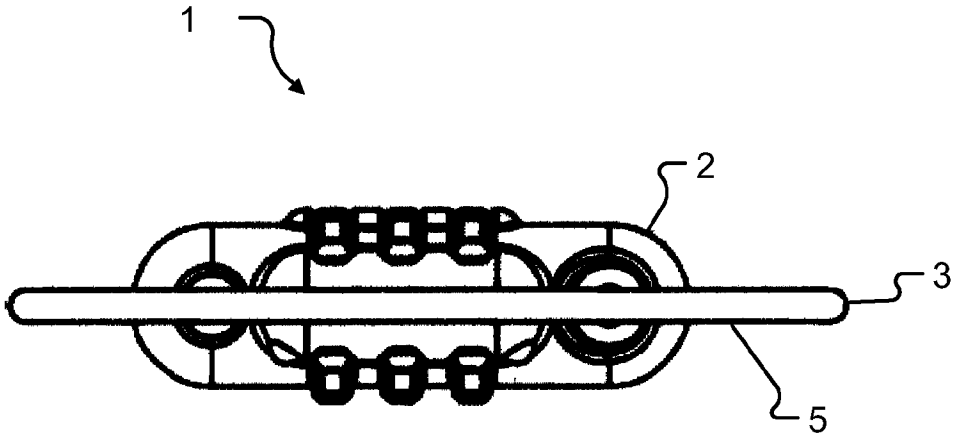
FIG. 3 shows a bottom view of the dual lock mechanism in an embodiment of the present invention.
Figure 4:
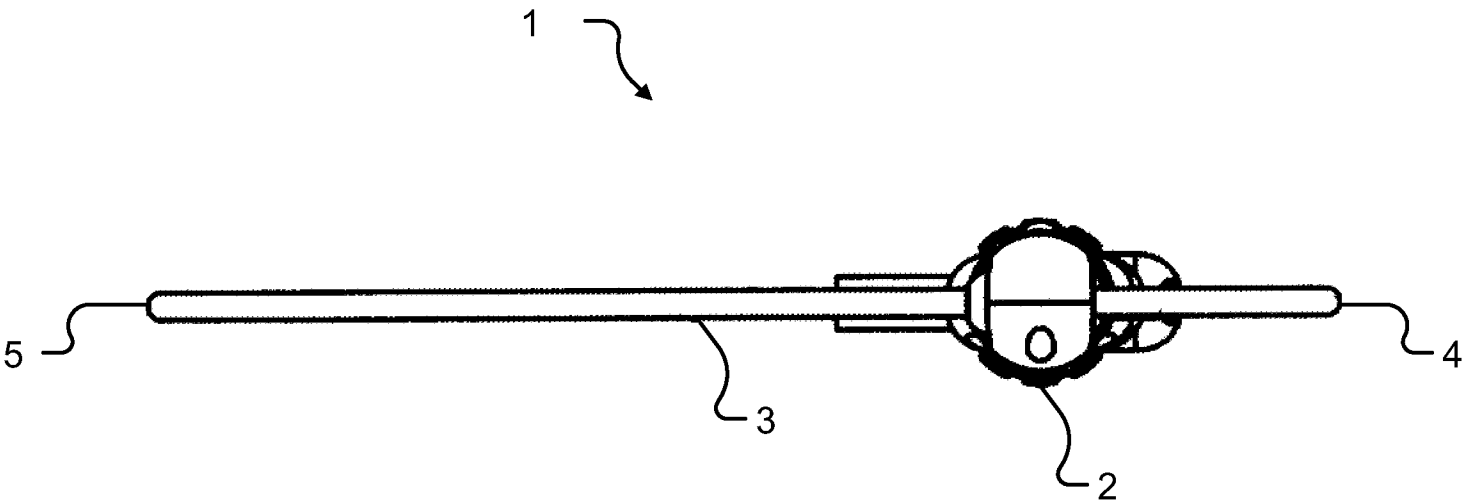
FIG. 4 shows a side view of the dual lock mechanism in an embodiment of the present invention.

Referring now to the Figures, like reference numerals and names refer to structurally and/or functionally similar elements thereof, and if objects depicted in the figures that are covered by another object, as well as the tag line for the element number thereto, may be shown in dashed lines. FIGS. 1-4 show various views of the dual lock mechanism of an embodiment of the present invention. Referring now to FIGS. 1-4, dual lock mechanism 1 has a dual lock 2 that receives a cable 3. A cinch portion 4 of cable 3 is secured to an opening of a bag (not shown) and a secure portion 5 that is wrapped around or secured to a stationary or heavy object.

Figure 5:
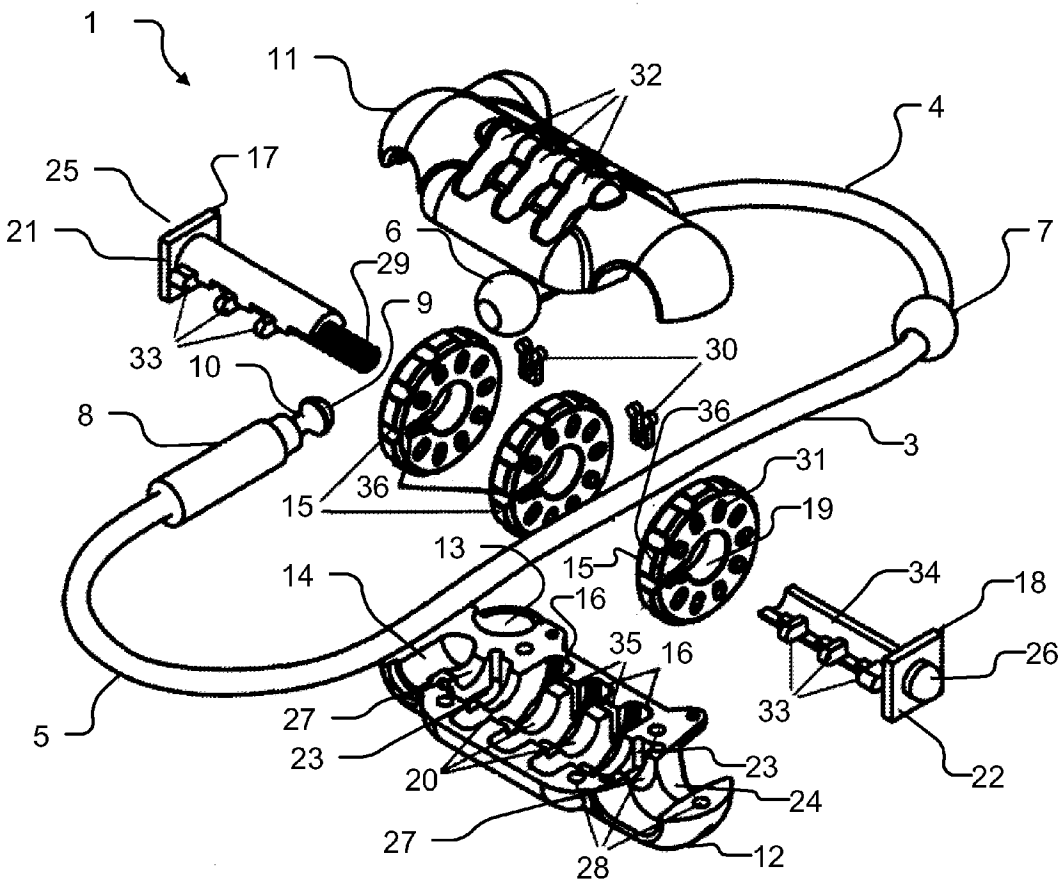
FIG. 5 shows an exploded view of the dual lock mechanism in an embodiment of the present invention.

FIG. 5 shows an exploded view of the dual lock mechanism of an embodiment of the present invention. Referring now to FIG. 5, cable 3 has an end fixed ball 6 located at a first end and a fixed ball 7 on cinch portion 4 of cable 3. The second end of cable 3 has a lock fob 8 having a tip 9 with a recess 10. Dual lock 2 has an upper housing 11 and a lower housing 12. As shown in lower housing 12 (and correspondingly in upper housing 11, not shown), pivot cavity 13 receives end fixed ball 6 pivotally. Lock fob channel 14 receives lock fob 8. Dials 15 are received in dial channels 16. Left key 17 and right key 18 are received in dial keyway 19 in each dial 15 as well as in housing keyways 20. Left key guide plate 21 and right key guide plate 22 are received in guide plate channels 23 respectively. Fixed ball channel 24 receives fixed ball 7. Left detent 25 (not visible in FIG. 5) and right detent 26 are received in detent channels 27 respectively. Multiple fastener holes 28 receive fasteners (not shown) to secure upper housing 11 to lower housing 12. Key spring 29 provides tension to left key 17 and right key 18. Dial indicator springs 30 engage with multiple dial indicator dimples 31. Multiple dial openings 32 in upper housing 11 and lower housing 12 allow access to dials 15. Left key 17 and right key 18 have multiple teeth 33 that engage and disengage with the dials 15 to lock and unlock. Spring channel 34 in left key 17 and right key 18 receive key spring 29. Dial indicator spring channels 35 receive dial indicator springs 30. Each dial 15 has a teeth channel 36 for receiving teeth 33 of left key 17 and right key 18.

Figures 6A, 6B, 6C, 6D:
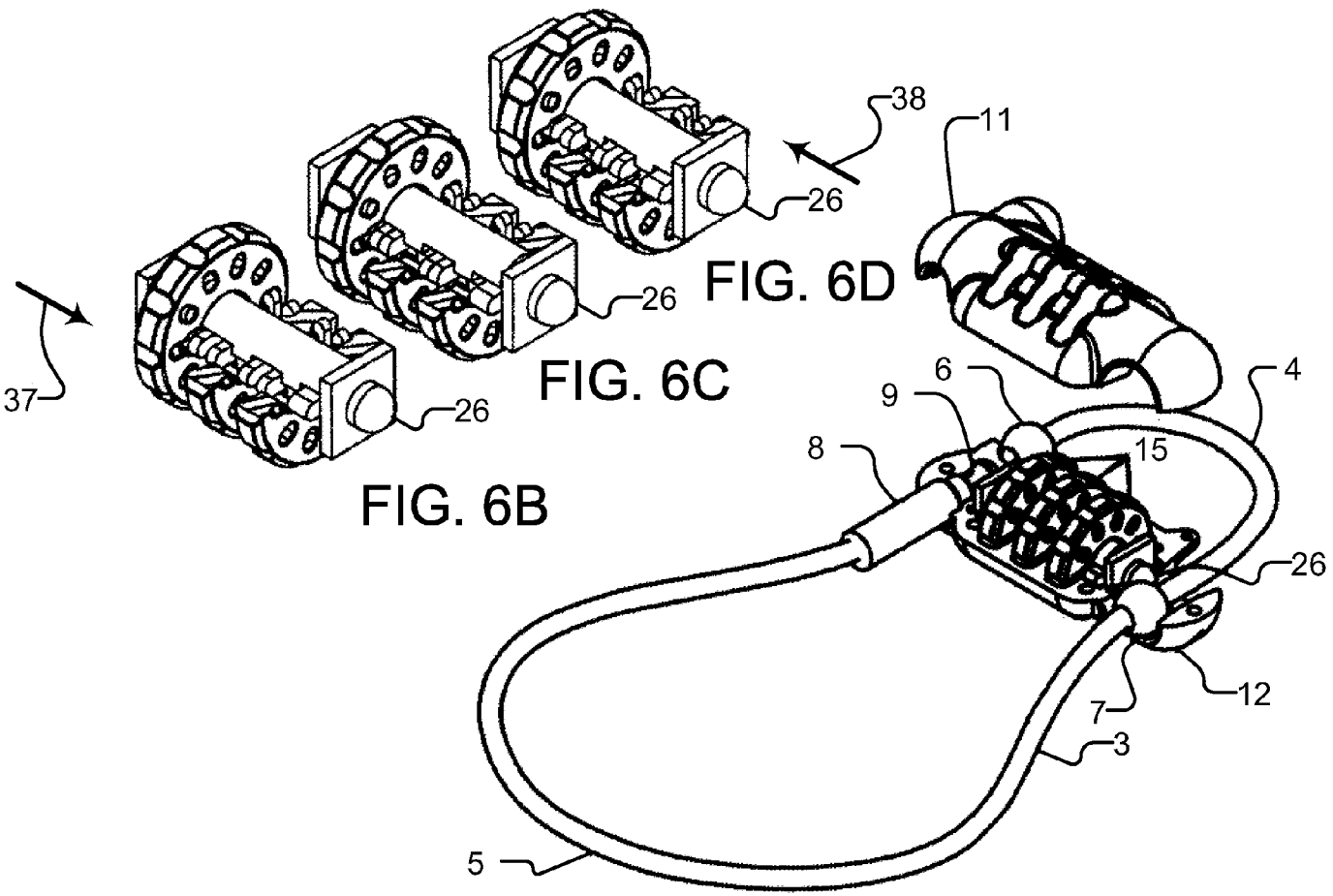
FIGS. 6A-6D show the detent key locking position in an embodiment of the present invention.
Figure 7:
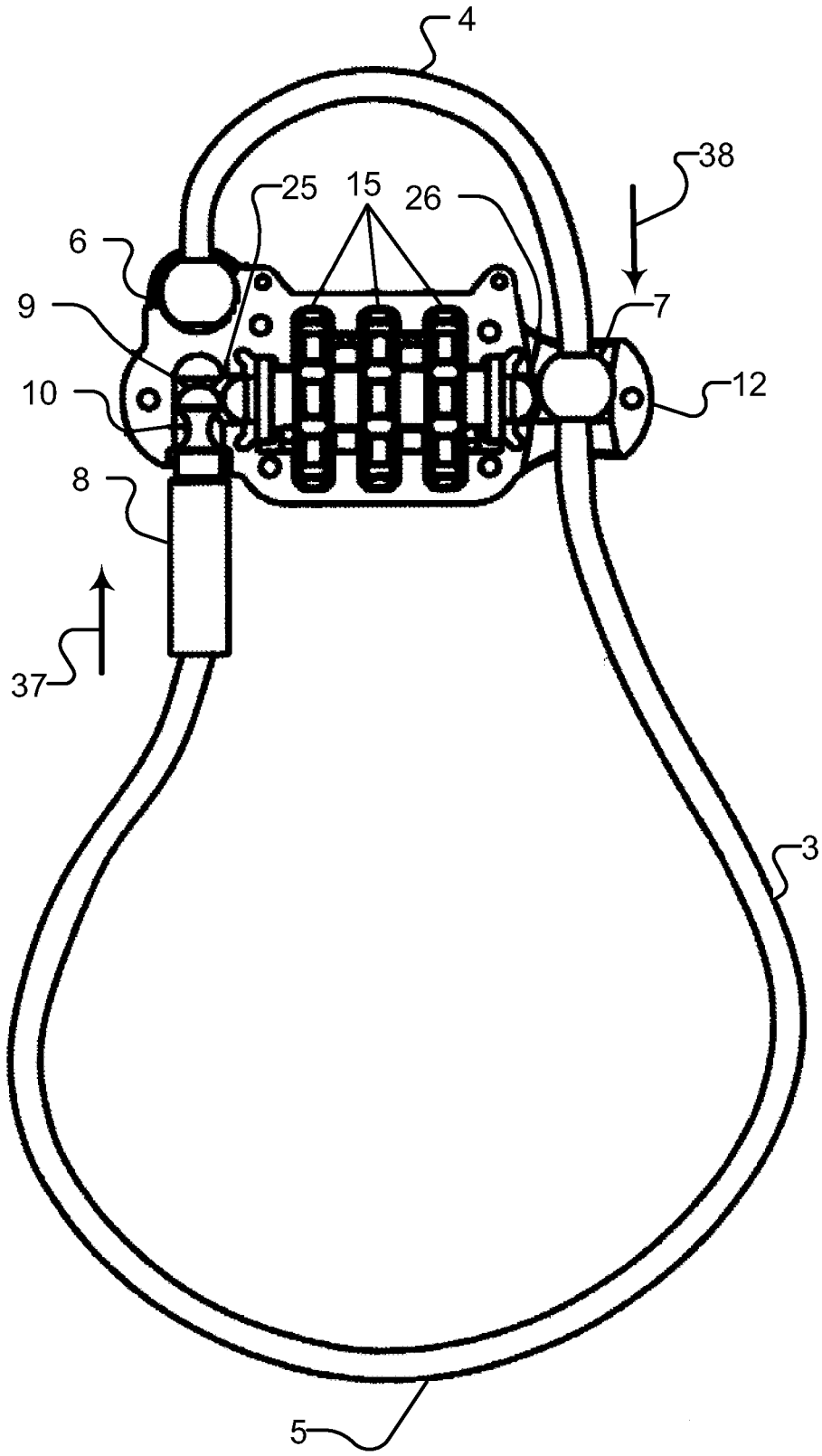
FIG. 7 shows a cutaway view of the split detent key, fixed ball of the cable, and lock fob of the dual lock mechanism in an embodiment of the present invention.
Figure 8:
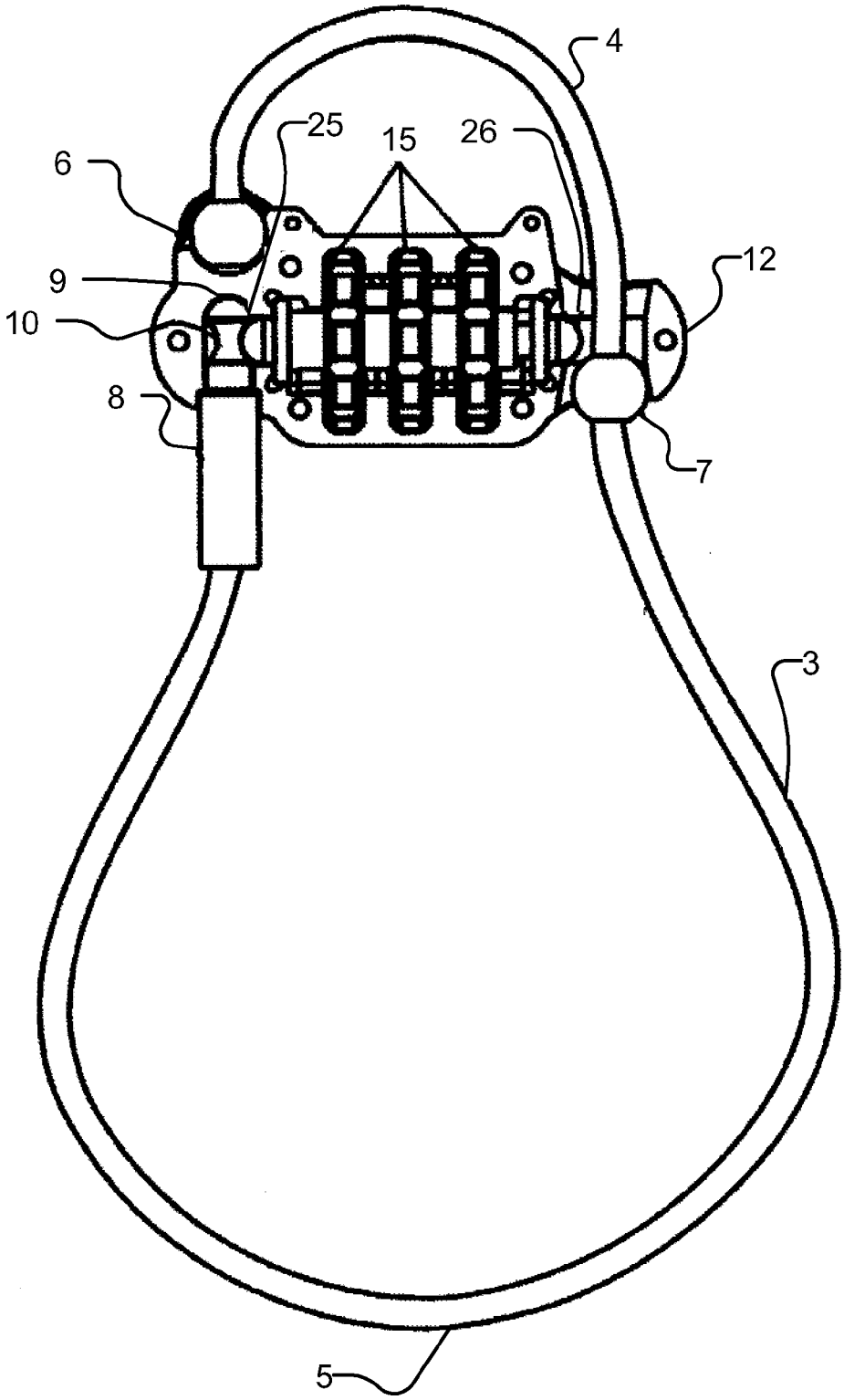
FIG. 8 shows a cutaway view of the function of the detent key and lock fob of the dual lock mechanism in an embodiment of the present invention.

FIGS. 6A-6D, FIG. 7, and FIG. 8 show the detent key locking position of an embodiment of the present invention. Referring now to FIGS. 6A-6D and FIG. 7, tip 9 of lock fob 8 engages with left detent 25 (not visible) and fixed ball 7 engages with right detent 26. Dials 15 are first turned to the unlock position, or combination, which is preset in the manufacturing stage. Each dial 15 has a plurality of faces with stamped or printed numbers, typically ranging from 0 to 9 (ten numbers total per dial), indicating a position dictated by the interaction of dial indicator spring 30 and dial indicator dimples 31 (see FIGS. 17A-17D). For example, for a manufacturing unlock setting or combination of "0-0-0" each dial 15 is turned to reveal a zero printed or stamped on each dial 15 so that the zeros are aligned at the top of dial opening 32. In this position, teeth 33 are aligned with teeth channel 36 so that teeth 33 can translate back and forth within dial keyway 19. When tip 9 of lock fob 8 is inserted into lock fob channel 14 in the direction indicated by arrow 37, tip 9 engages with left detent 25 and forces left detent 25 to move to the right as shown in FIG. 6B (left detent 25 actuated, right detent 26 stationary). As tip 9 moves farther in, key spring 29 forces left detent 25 into recess 10. Similarly, when fixed ball 7 is forced past right detent 26 in the direction indicated by arrow 38, right detent 26 moves to the left as shown in FIG. 6D (left detent 25 stationary, right detent 26 actuated). Typically, cable 3 is pulled in the direction to reduce cinch portion 4 in order to secure the contents of the bag 42 (see FIGS. 14, 15, and 16). When fixed ball 7 is moved past right detent 26, key spring 29 forces right detent 26 to move back to the right. FIG. 6C shows both left detent 25 and right detent 26 stationary. The split or bifurcated left key 17 and right key 18 allow independent movement of the fixed ball 7 to move into its security position and the lock fob 8 to move to its security position. Once clicked into their security positions, the dials 15 may be scrambled, locking left detent 25 and right detent 26 into place, securing tip 9 within lock fob channel 14 and preventing cinch portion 4 of cable 3 from loosening due to fixed ball 7 being blocked by right detent 26. The dual security system is now locked as shown in FIG. 8.

Figure 9:
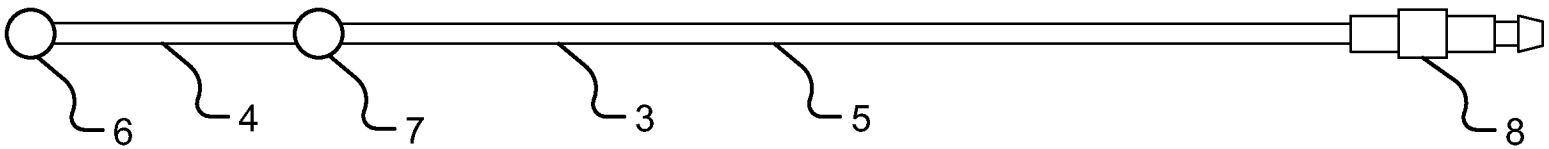
FIG. 9 shows the cable with fixed balls attached with dimensions in an embodiment of the present invention.

FIG. 9 shows the cable 3 with end fixed ball 6, fixed ball 7, and lock fob 8 attached thereto with secure portion 5 being approximately four to five times longer than cinch portion 4 in an embodiment of the present invention. Cable 3 can be a stainless steel or braided cable or other suitable material in a diameter of about ⅛ inch to 3/32 inch.

Figure 10:
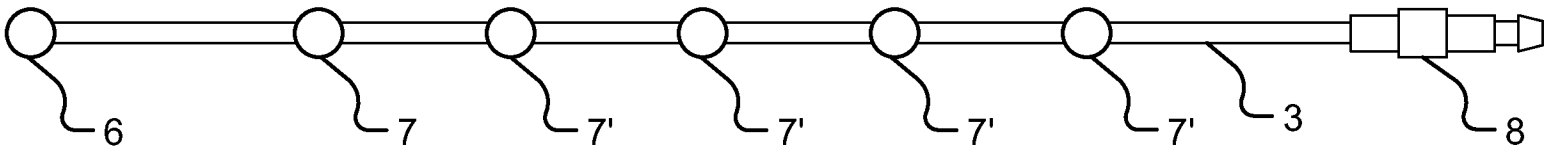
FIG. 10 shows the cable with added fixed balls attached with dimensions of the dual lock mechanism in an embodiment of the present invention.

FIG. 10 shows an alternate embodiment of cable 3' with additional fixed balls 7' attached with approximately equal spacing there between.

Figure 11:
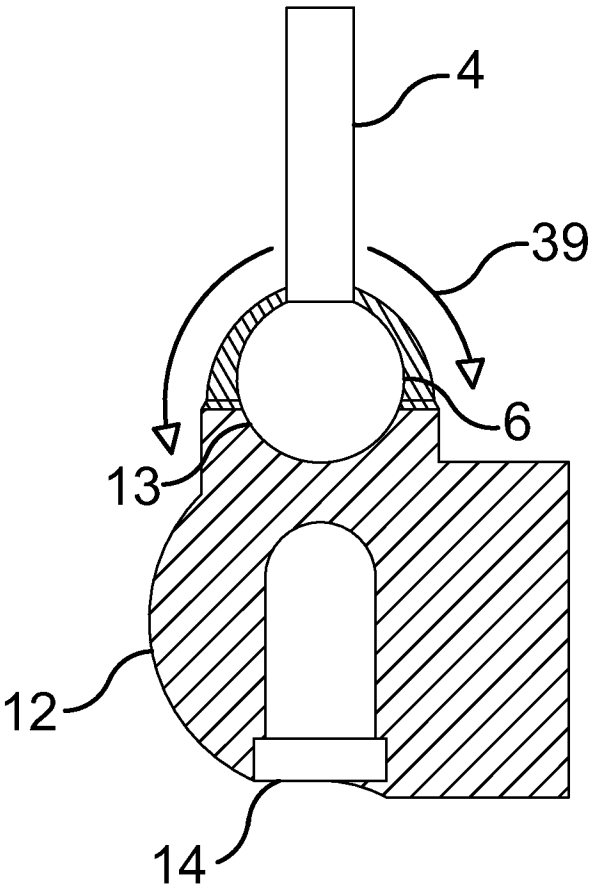
FIG. 11 shows a cutaway view of a fixed ball joint of the dual lock mechanism in an embodiment of the present invention.

FIG. 11 shows a cutaway view of a fixed ball joint 40 of the dual lock mechanism in an embodiment of the present invention. Referring now to FIG. 11, end fixed ball 6 secured in pivot cavity 13 is free to rotate or pivot freely within pivot cavity 13 in the direction indicated by arrow 39.

Figure 12:
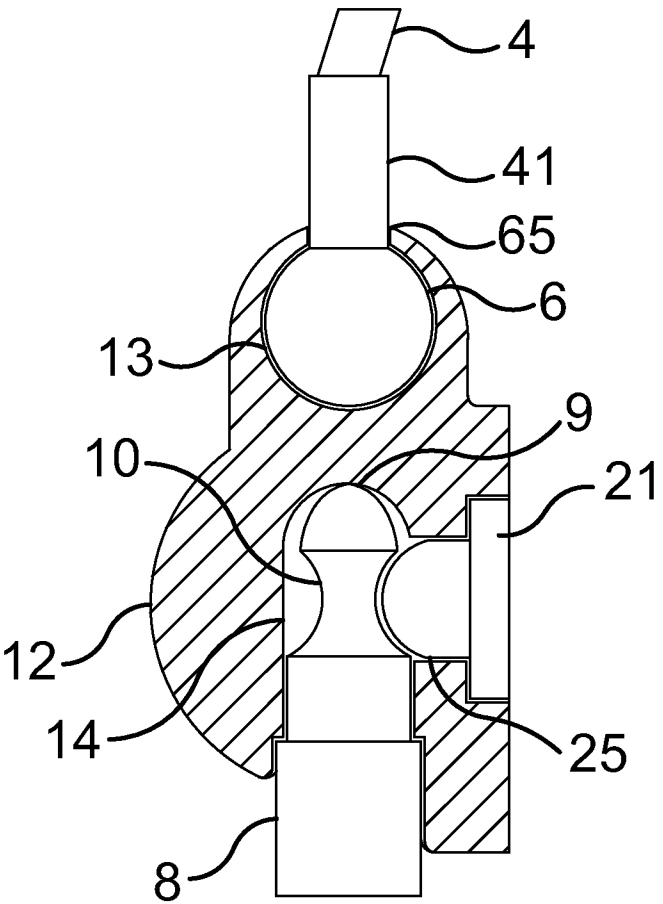
FIG. 12 shows a cutaway view of an alternative embodiment of a fixed ball joint, with the lock fob inserted, of the dual lock mechanism in an embodiment of the present invention.

FIG. 12 shows a cutaway view of an alternative embodiment of a fixed ball joint 40', with the lock fob inserted, of the dual lock mechanism in an embodiment of the present invention. Referring now to FIG. 12, end fixed ball 6 has a sheath 41 that fits snugly within opening 65, and does not allow rotation or pivoting. Lock fob 8 is shown engaged with left detent 25 at recess 10 within lock fob channel 14.

Figure 13:
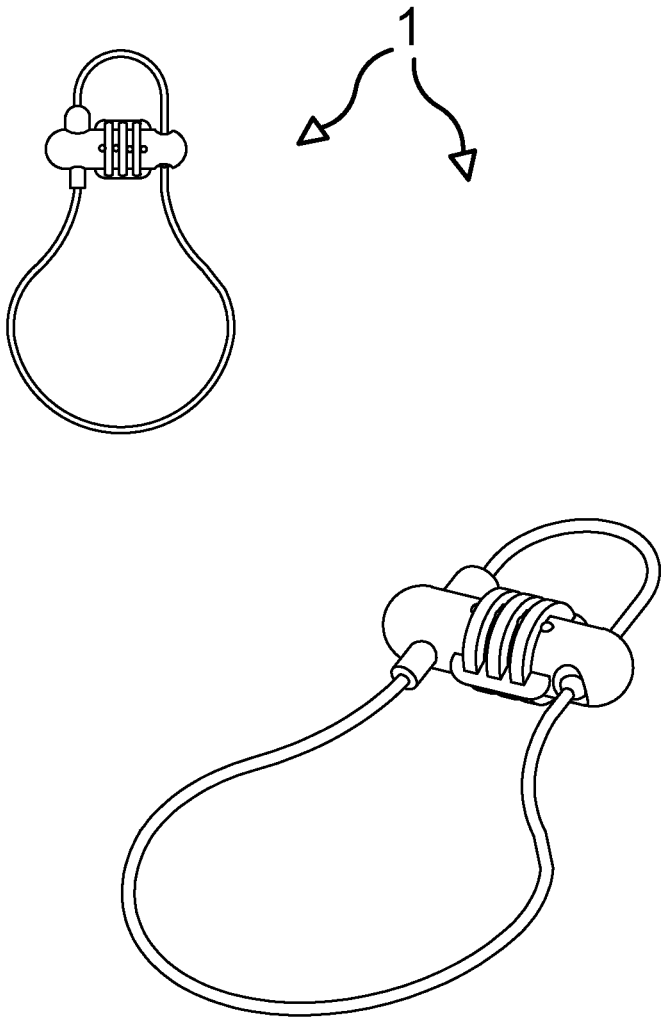
FIG. 13 shows perspective views of the dual lock mechanism in an embodiment of the present invention.

FIG. 13 shows perspective views of the dual lock mechanism in an embodiment of the present invention.

Figure 14:
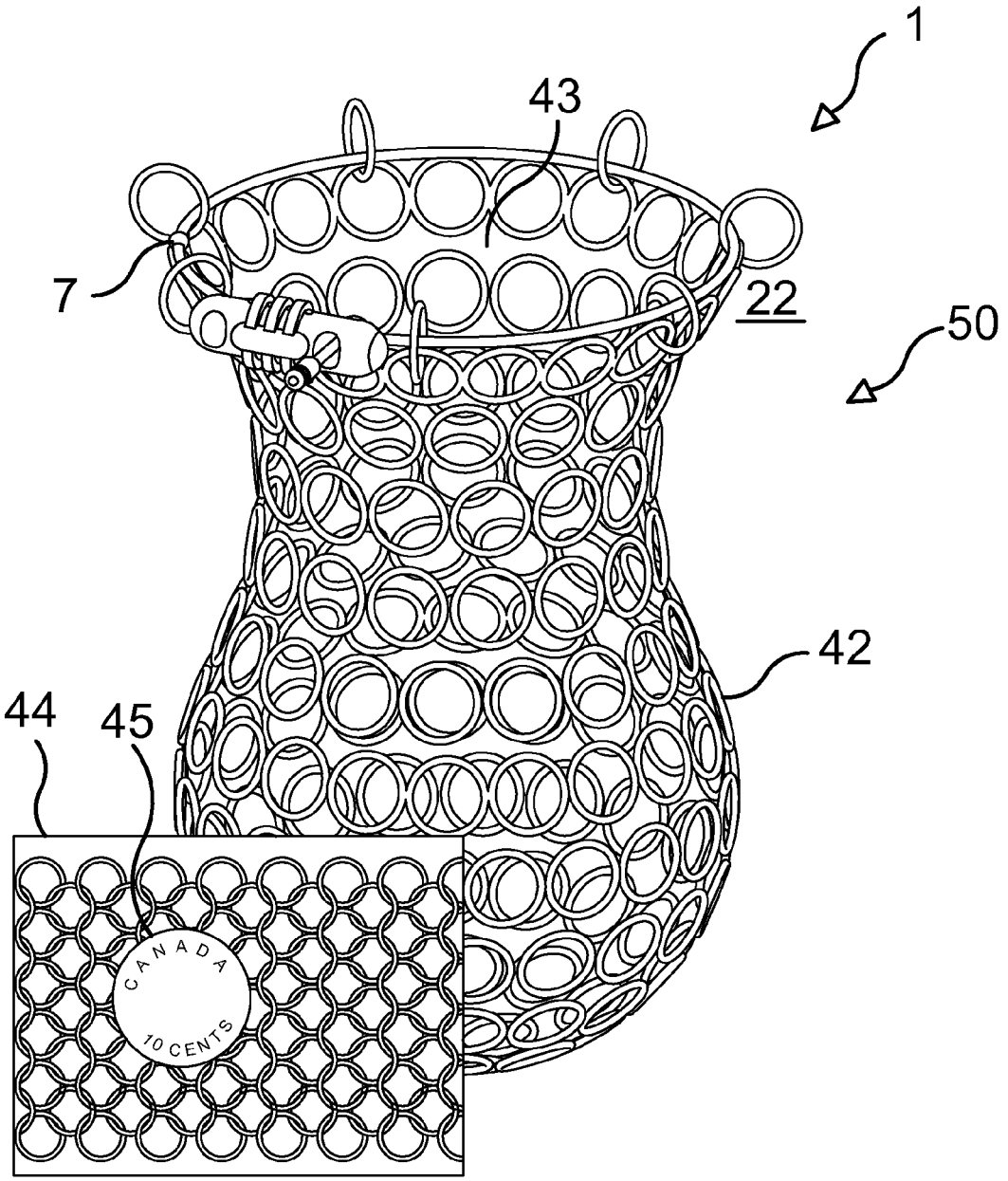
FIG. 14 shows the chainmail configuration of the mesh bag with the dual lock mechanism in an embodiment of the everyday safe of the present invention.

FIG. 14 shows the chainmail configuration of the mesh bag with the dual lock mechanism in an embodiment of the everyday safe of the present invention. Referring now to FIG. 14, everyday safe 50 has a chainmail mesh bag 42 and dual lock mechanism 1 shown in the open position. Fixed ball 7 has not yet been pulled past right detent 26 within fixed ball channel 24. A user may place personal belongings and valuables inside chainmail mesh bag 42 through opening 43. Insert section 44 shows an interlocking ring style of chainmail mesh bag 42 with a penny 45 to give an indication of size of the individual interlocking rings.

Figure 15:
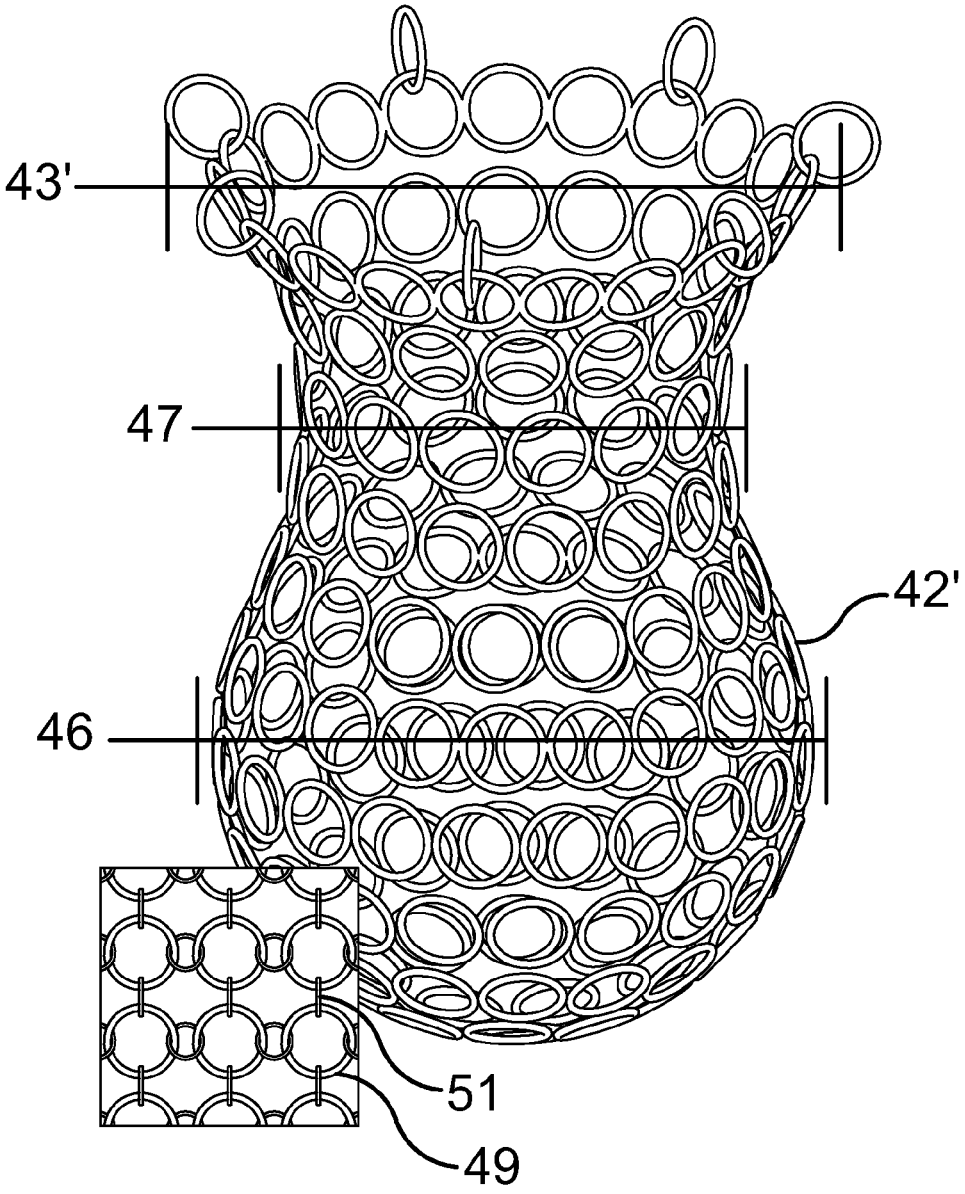
FIG. 15 shows the chainmail configuration of the mesh bag with relative dimensions of the bag in an embodiment of the present invention.

FIG. 15 shows the chainmail configuration of the mesh bag with relative dimensions of the bag in an embodiment of the present invention. Referring now to FIG. 15, the opening 43' is approximately the same size as the compartment portion 46, with a narrow waist portion 47. Insert section 48 shows a connecting ring style of chainmail mesh bag 42' having a plurality of large rings 49 connected to each other through a plurality of smaller rings 51.

Figure 16:
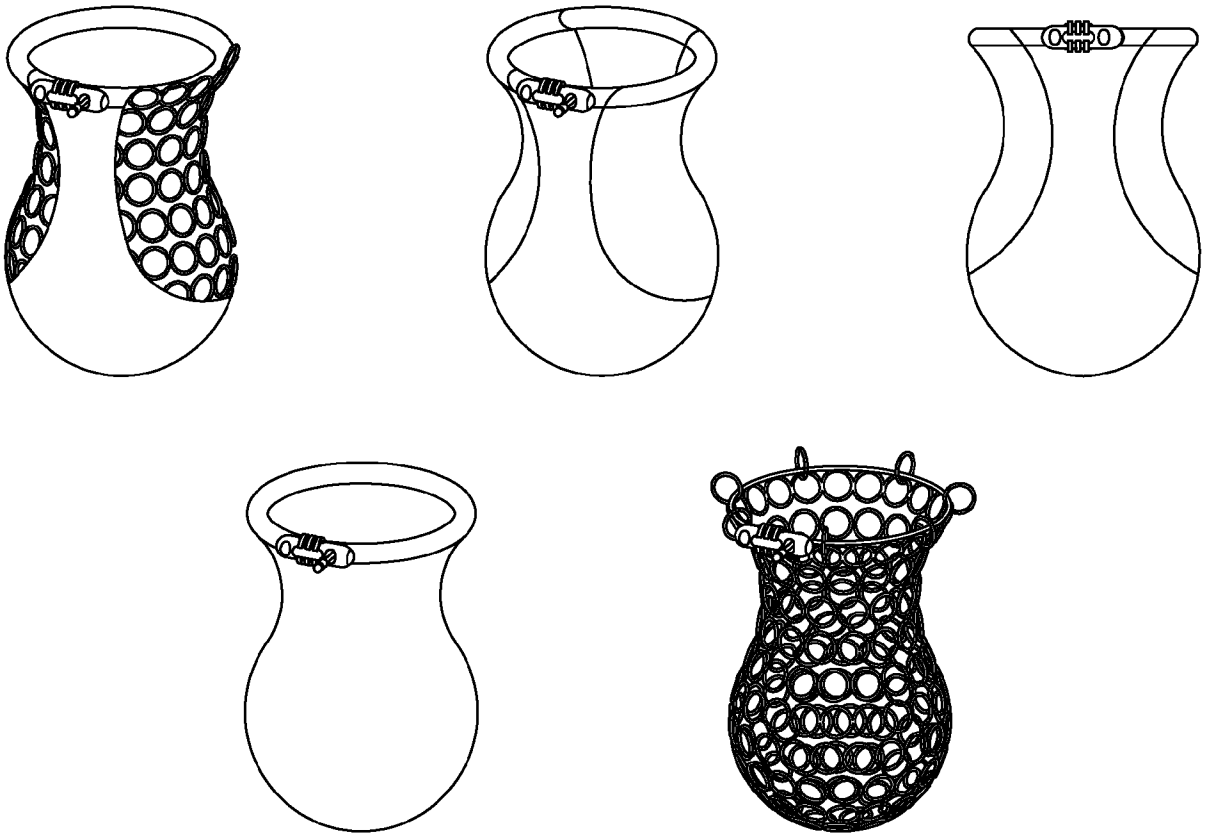
FIG. 16 shows several views of multiple finished products in embodiments of the present invention.
Figure 17A:
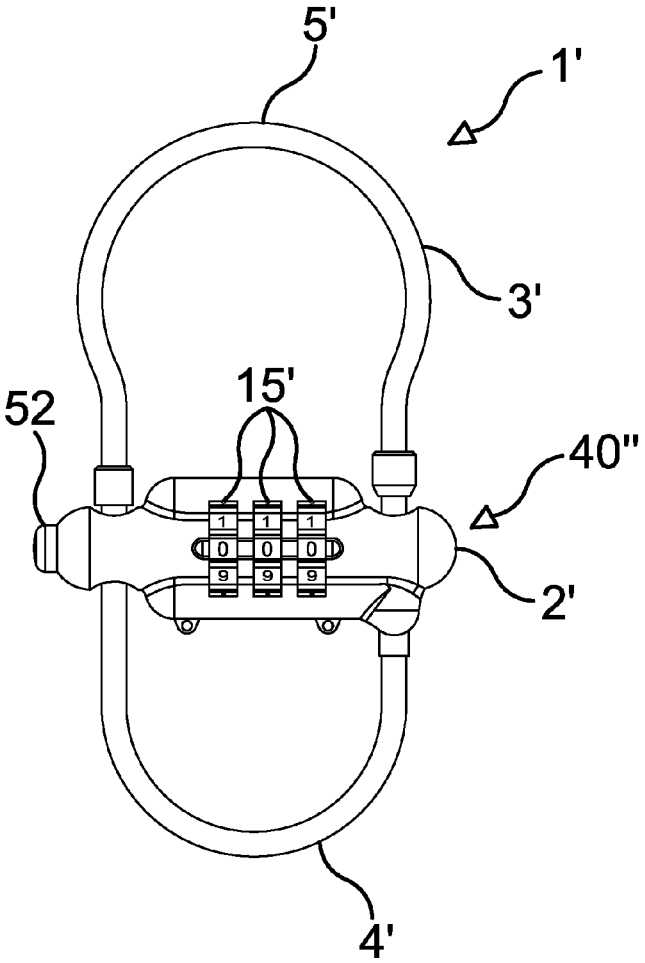
FIGS. 17A-17D show an alternative embodiment of the dual lock mechanism in an embodiment of the present invention.
Figure 17B:
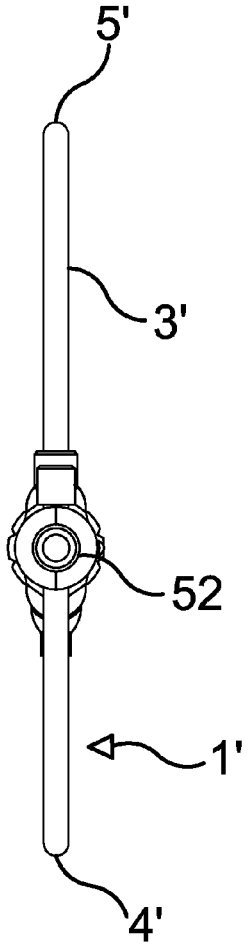
Figure 17C:
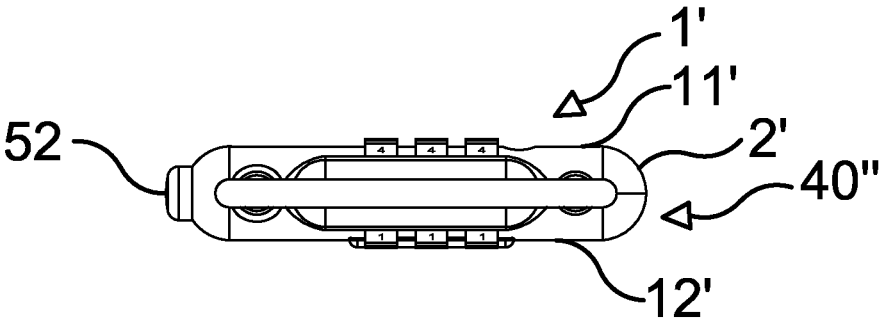
Figure 17D:
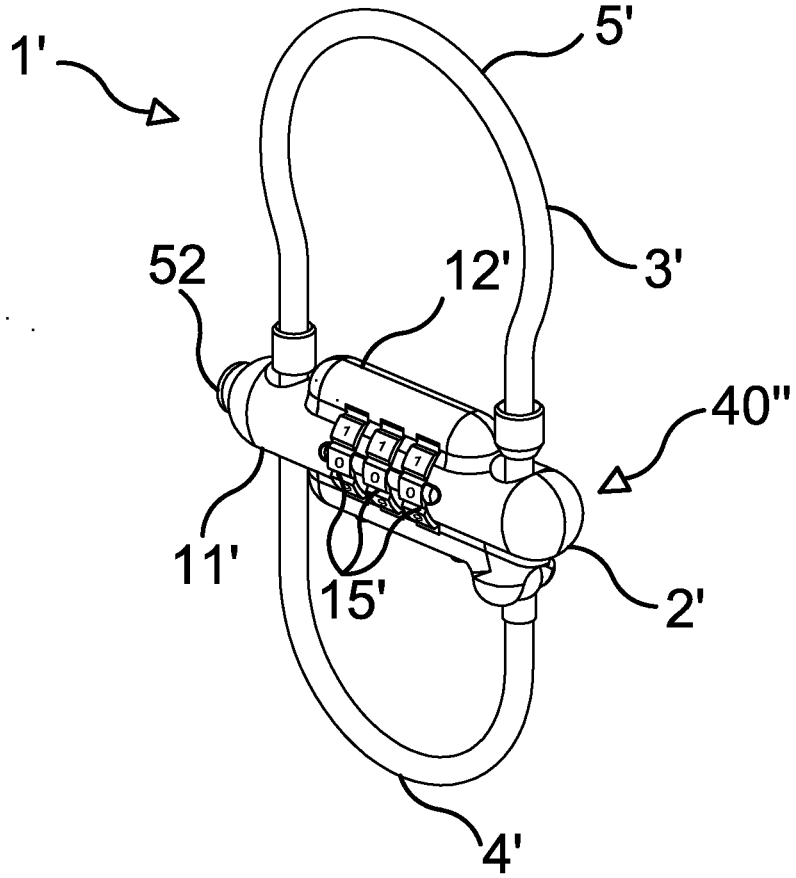

FIG. 16 shows several views of multiple finished products in embodiments of the present invention. Referring now to FIG. 16, the bag or bag portion of the everyday safe may be chainmail or solid fabrics of various styles, colors, combination of colors, thicknesses, etc.

FIGS. 17A-17D show an alternative embodiment of the dual lock mechanism in an embodiment of the present invention. Referring now to FIGS. 17A-17D, dual lock mechanism 1' has mostly similar features and functions as dual lock mechanism 1 except for the following. First, the user can set the unlock position or combination, and change the unlock position or combination, at any time. Second, the dual lock 2' has a button 52 that when pressed will release both locking mechanisms.

Figure 18:
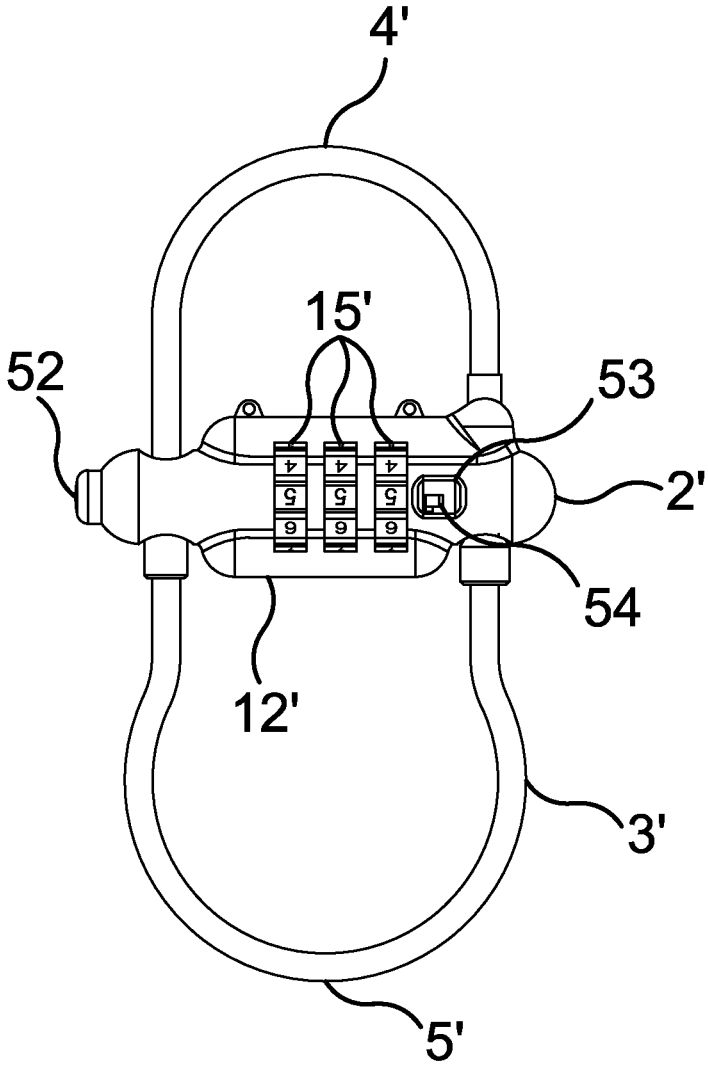
FIG. 18 shows a bottom view of the dual lock mechanism in an embodiment of the present invention.

FIG. 18 shows a back view of the dual lock mechanism in an embodiment of the present invention. Referring now to FIG. 18, window 53 in lower housing 12' allows the user access to lever 54 which when depressed, allows the user to turn each dial 15' to whatever position desired, such as 1-3-6, 2-2-7, 8-5-3, etc. and when the lever is released, whatever position dials 15' are in is the new unlock position or combination. This type of mechanism is well known in the art, and further details are not provided herein.

Figure 19:
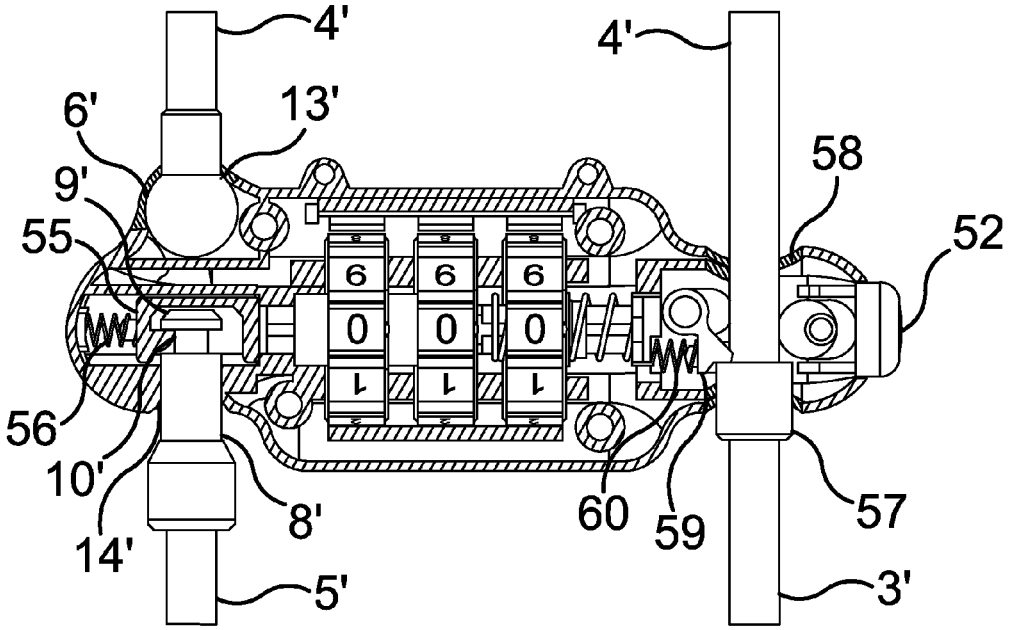
FIG. 19 shows a cutaway view of the dual lock mechanism with the release button not pressed in an embodiment of the present invention.

FIG. 19 shows a cutaway view of the dual lock mechanism with the release button not pressed in an embodiment of the present invention. Referring now to FIG. 19, end fixed ball 6' is received within pivot cavity 13'. Lock fob 8' is received in lock fob channel 14'. Tip 9' and recess 10' engage with lock fob pawl 55 with the assist of lock fob spring 56. Hub 57 passes through hub channel 58 and engages with hub pawl 59 with the assist of hub spring 60.

Figure 20:
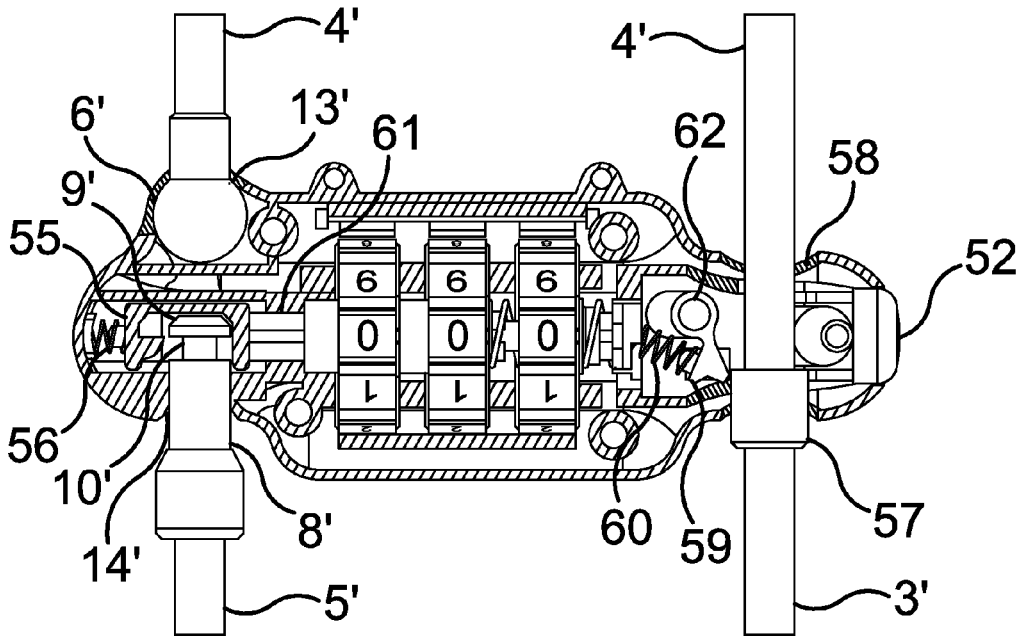
FIG. 20 shows a cutaway view of the dual lock mechanism with the release button depressed in an embodiment of the present invention.

FIG. 20 shows a cutaway view of the dual lock mechanism with the release button depressed in an embodiment of the present invention. Referring now to FIG. 20, when button 52 is depressed, connecting rod 61 causes lateral movement of lock fob pawl 55, disengaging lock fob pawl 55 from tip 9' and recess 10' of lock fob 8'. Simultaneously when button 52 is depressed, hub pawl 59 rotates about post 62 and flexes hub spring 60 in a downward direction disengaging hub 57 from hub pawl 59. Thus, both components of the dual lock 2' are simultaneously disengaged. The advantage of this arrangement is that once the user has turned the dials to the unlock position or combination, the user can depress button 52 and simultaneously release both locking mechanisms. The user can then scramble the dials so others can't see the sequence of numbers that make up the unlock position. The user can then reset both locking mechanism by simply inserting lock fob 8' into lock fob channel 14' and engaging lock fob pawl 55, and pulling cable 3' down through hub channel 58 to again engage hub 57 with hub pawl 59.

Figure 21:
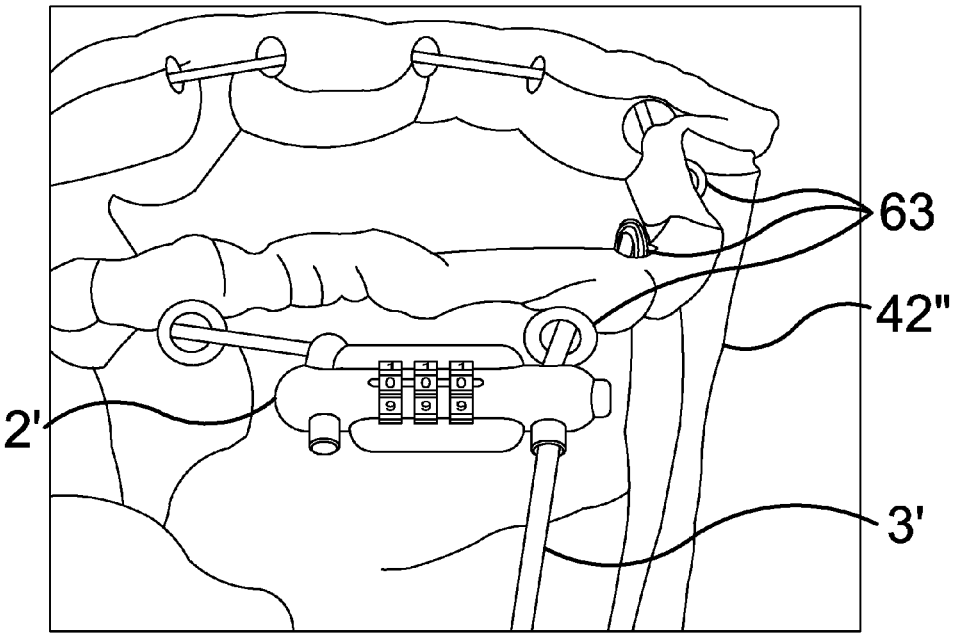
FIGS. 21-23 show the steps of using the everyday safe in an embodiment of the present invention.
Figure 22:
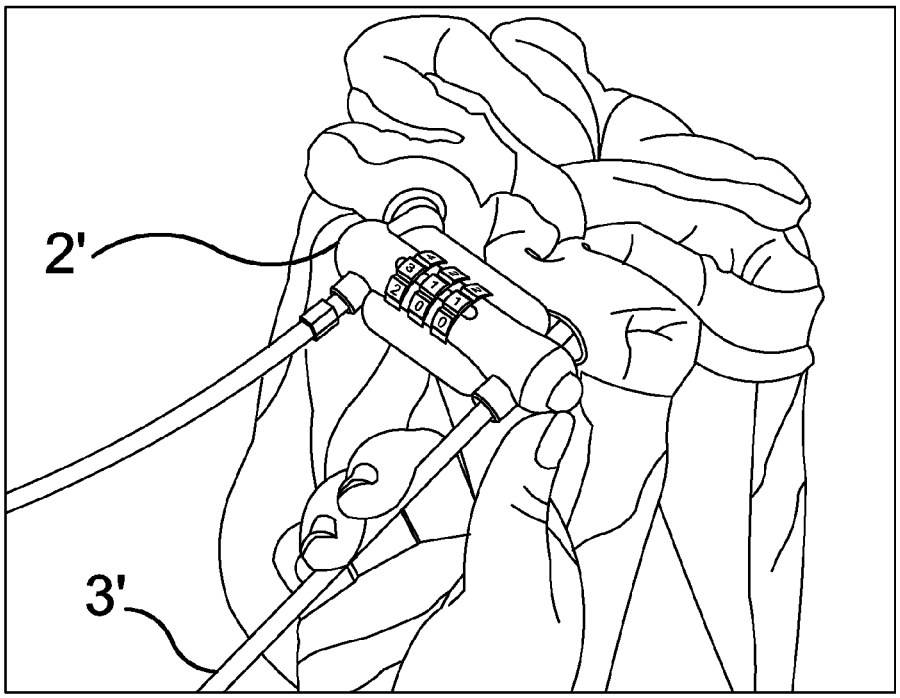
Figure 23:
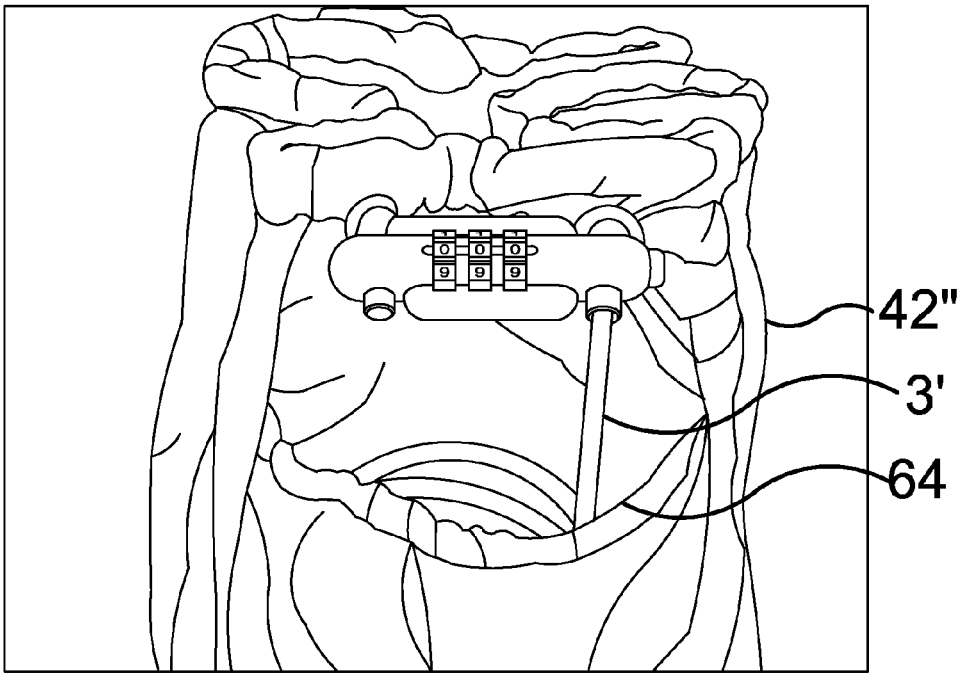

FIGS. 21-23 show the steps of using the everyday safe in an embodiment of the present invention. Referring now to FIGS. 21-23, in FIG. 21 bag 42" is in an open position. The unlock position or combination has been dialed in with dials 15', and button 52 depressed, releasing both ends of dual lock 2'. Lock fob 8' of cable 3', if it has not already been inserted, is inserted in multiple eyelets 63 of bag 42" and run through hub channel 58.

Referring now to FIG. 22, the user has pulled cable 3' through hub channel 58 until hub 57 engages with hub pawl 59. This closes the opening of bag 42" with cinch portion 4' of cable 3'. The user then loops secure portion 5' around a pole or other sturdy object, and inserts lock fob 8' into lock fob channel 14' engaging tip 9' and recess 10' with lock fob pawl 55. To gain access to the contents of bag 42", or to unsecure secure portion 5' from around the pole or object, the user turns the dials 15' to the unlock position or combination, and depresses button 52, simultaneously unlocking the dual lock 2'.

Referring now to FIG. 23, when unsecure secure portion 5' is not needed, it can be looped and placed inside pouch 64 on the outside of bag 42".

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims. It will be understood by those skilled in the art that many changes in construction and widely differing embodiments and applications will suggest themselves without departing from the scope of the disclosed subject matter.

What is claimed is:

1. An apparatus for securing items comprising:

a body containing a dual lock within the body, wherein a first lock mechanism is located at a first end within the body, and a second lock mechanism is located at a second end within the body;

a cable fixed at a first end to the first end of the body;

a lock fob located at a second end of the cable;

a bag having an open end, and a plurality of openings located at the open end of the bag, wherein the plurality of openings receive the lock fob and cable there through;

a fixed ball affixed to the cable at a first distance from the first end of the cable;

a channel located in the second end of the body, the channel receiving the fixed ball in a first locked position and a first unlocked position in the second lock mechanism;

a lock fob channel located in the first end of the body for receiving the lock fob in a second locked position and in a second unlocked position in the first lock mechanism; and at least one dial in the body, the at least one dial movable between the first and second locked positions and the first and second unlocked positions of the first and second lock mechanisms;

wherein items are secured within the bag when the fixed ball is received in the channel at the second end of the body in the first locked position of the second lock mechanism which closes the open end of the bag.

2. The apparatus according to claim 1 further comprising:

an end fixed ball located at the first end of the cable; and a pivot cavity located in the first end of the body;

wherein the end fixed ball is received in the pivot cavity to pivotably fix the first end of the cable to the first end of the body.

3. The apparatus according to claim 1 further comprising:

a first detent that is movable into and out of the channel of the second lock mechanism;

wherein in the first locked position of the second lock mechanism, the first detent moves into the channel preventing the fixed ball from moving out of the channel in a second direction opposite the first direction that the fixed ball moved into the channel, and in the first unlocked position of the second lock mechanism the first detent moves out of the channel allowing the fixed ball to move in and out of the channel in the first and second directions.

4. The apparatus according to claim 1 further comprising:

a second detent that is movable into and out of the lock fob channel of the first lock mechanism;

the lock fob further comprises a tip and a recess located before the tip;

wherein in the second locked position of the first lock mechanism, the second detent moves into the lock fob channel and engages with the recess of the lock fob preventing the lock fob from moving out of the lock fob channel, and in the second unlocked position of the first lock mechanism the second detent moves out of the lock fob channel and disengages with the recess of the lock fob allowing the lock fob to move out of the lock fob channel.

5. The apparatus according to claim 1 wherein the cable further comprises:

a cinch portion of the cable located between the first end of the cable and the fixed ball; and a secure portion of the cable located between the fixed ball and the lock fob;

wherein the cinch portion of the cable closes the open end of the bag when the fixed ball is in the first locked position of the second lock mechanism, and the secure portion of the cable secures the bag to an object that the secure portion of the cable is looped around when the lock fob is in the second locked position of the first lock mechanism.

6. The apparatus according to claim 1 wherein the bag further comprises:

a chainmail mesh that is cut, slash, and tear-resistant.

7. The apparatus according to claim 1 wherein the at least one dial further comprises three dials, wherein each of the three dials has a plurality of positions, wherein each of the three dials must be moved into a predetermined one of the plurality of positions in order for the first and second unlocked positions of the first and second lock mechanisms to be enabled.

8. An apparatus for securing items comprising:

a body containing a dual lock within the body, wherein a first lock mechanism is located at a first end within the body, and a second lock mechanism is located at a second end within the body;

a cable fixed at a first end to the first end of the body;

a lock fob located at a second end of the cable;

a bag having an open end, and a plurality of openings located at the open end of the bag, wherein the plurality of openings receive the lock fob and cable there through;

a hub affixed to the cable at a first distance from the first end of the cable;

a hub channel located in the second end of the body, the hub channel receiving the hub in a first locked position and a first unlocked position in the second lock mechanism;

a lock fob channel located in the first end of the body for receiving the lock fob in a second locked position and in a second unlocked position in the first lock mechanism;

at least one dial in the body, the at least one dial movable between the first and second locked positions and the first and second unlocked positions of the first and second lock mechanisms; and a buttonon one end of the body, wherein pressing the button releases the hub from the first locked position in the second lock mechanism and also releases the lock fob from the second locked position in the first lock mechanism;

wherein items are secured within the bag when the hub is received in the hub channel at the second end of the body in the first locked position of the second lock mechanism which closes the open end of the bag.

9. The apparatus according to claim 8 further comprising:

an end fixed ball located at the first end of the cable; and a pivot cavity located in the first end of the body;

wherein the end fixed ball is received in the pivot cavity to pivotably fix the first end of the cable to the first end of the body.

10. The apparatus according to claim 8 further comprising:

a hub pawl that is movable into and out of the hub channel of the second lock mechanism;

wherein in the first locked position of the second lock mechanism, the hub pawl moves into the hub channel preventing the hub from moving out of the hub channel in a second direction opposite the first direction that the hub moved into the hub channel, and in the first unlocked position of the second lock mechanism, the hub pawl moves out of the hub channel allowing the hub to move in and out of the hub channel in the first and second directions.

11. The apparatus according to claim 10 further comprising:

a lock fob pawl that is movable into and out of the lock fob channel of the first lock mechanism;

the lock fob further comprises a tip and a recess located before the tip;

wherein in the second locked position of the first lock mechanism, the lock fob pawl moves into the lock fob channel and engages with the recess of the lock fob preventing the lock fob from moving out of the lock fob channel, and in the second unlocked position of the first lock mechanism, the lock fob pawl moves out of the lock fob channel and disengages with the recess of the lock fob allowing the lock fob to move out of the lock fob channel.

12. The apparatus according to claim 11 wherein pressing the button moves the hub pawl out of the hub channel in the second lock mechanism, and moves the lock fob pawl out of the lock fob channel in the first lock mechanism, releasing the hub from the first locked position in the second lock mechanism, and releasing the lock fob from the second locked position in the first lock mechanism.

13. The apparatus according to claim 8 wherein the cable further comprises:

a cinch portion of the cable located between the first end of the cable and the hub; and a secure portion of the cable located between the hub and the lock fob;

wherein the cinch portion of the cable closes the open end of the bag when the hub is in the first locked position of the second lock mechanism, and the secure portion of the cable secures the bag to an object that the secure portion of the cable is looped around when the lock fob is in the second locked position of the first lock mechanism.

14. The apparatus according to claim 8 wherein the bag further comprises:

a chainmail mesh that is cut, slash, and tear-resistant.

15. The apparatus according to claim 14 further comprising:

a lever in the body, wherein when the lever is depressed, each of the three dials can be turned to any one of the plurality of positions desired to establish a new combination, and when the lever is released, whatever one of the plurality of positions each of the three dials are in establishes a new unlock position.

16. The apparatus according to claim 8 wherein the at least one dial further comprises three dials, wherein each of the three dials has a plurality of positions, wherein each of the three dials must be moved into a predetermined one of the plurality of positions in order for the first and second unlocked positions of t second lock mechanisms to be enabled.

17. A method for securing items, the method comprising:

(a) inserting a lock fob attached to a second end of a cable through a plurality of openings in an open end of a bag, wherein a first end of the cable is secured to a first end of a body;

(b) passing the lock fob and a secure portion of the cable through a hub channel located in a second end of the body until a hub affixed to the cable at a first distance from the first end of the cable passes into the hub channel in a first locked position in a second lock mechanism, which closes the open end of the bag securing items placed within the bag;

(c) passing the secure portion of the cable around an object; and (d) inserting the lock fob into a lock fob channel located in the first end of the body in a second locked position in a first lock mechanism which secures the bag to the object.

18. The method for securing items according to claim 17, further comprising the step of:

rotating at least one dial in the dual lock to a one of a plurality of positions; and pressing a button located on one end of the body, wherein pressing the button unlocks the first locked position in the second lock mechanism and the second locked position in the first lock mechanism, releasing the lock fob from the lock fob channel and releasing the hub from the hub channel.

19. The method for securing items according to claim 18, further comprising the step of:

rotating three dials in the dual lock so that each dial is in one of a plurality of positions; and pressing a button located on one end of the body, wherein pressing the button unlocks the first locked position in the second lock mechanism and the second locked position in the first lock mechanism, releasing the lock fob from the lock fob channel and releasing the hub from the hub channel.

20. The method for securing items according to claim 18, further comprising the step of:

securing an end fixed ball located at the first end of the cable into a pivot cavity located in the first end of the body to pivotably fix the first end of the cable to the first end of the body.

* * * * *

UNITED STATES PATENT AND TRADEMARK OFFICE

CERTIFICATE OF CORRECTION

PATENT NO. : 8,528,371 B2
APPLICATION NO. : 13/204651
DATED : September 10, 2013
INVENTOR(S) : Evan Scott Spiegel It is certified that error appears in the above-identified patent and that said Letters Patent is hereby corrected as shown below:

In the Claims

Column 8,
line 52, Claim 16, Delete the letter "t" after the word "of".
line 52, Claim 16, Add the words "the first and" before the word "second".

Signed and Sealed this
Twelfth Day of November, 2013

Teresa Stanek Rea
*Deputy Director of the United States Patent and Trademark Office*